US005839034A

United States Patent [19]

Sato

[11] Patent Number: 5,839,034

[45] Date of Patent: Nov. 17, 1998

[54] IMAGE FORMING DEVICE HAVING A PHOTOSENSITIVE DRUM AND DEVELOPING ROLLER THAT ROTATE IN THE SAME DIRECTION

[75] Inventor: Shougo Sato, Seto, Japan

[73] Assignee: Brother Kogyo Kabushiki Kaisha, Nagoya, Japan

[21] Appl. No.: 712,423

[22] Filed: Sep. 11, 1996

[30] Foreign Application Priority Data

Sep. 12, 1995 [JP] Japan ..... 7-260765

[51] Int. Cl.[6] ..... G03G 15/00; G03G 15/08

[52] U.S. Cl. ..... 399/167; 399/236

[58] Field of Search ..... 399/167, 236

[56] References Cited

U.S. PATENT DOCUMENTS 5,436,700 7/1995 Kikuchi et al. ..... 399/111

5,628,043 5/1997 Ikeda et al. ..... 399/236 X

*Primary Examiner*—William J. Royer

*Attorney, Agent, or Firm*—Oliff & Berridge, PLC

[57] ABSTRACT

An image forming device for forming images on a sheet transported along a sheet-transport pathway from a sheet supply tray to a sheet discharge unit includes a photosensitive drum rotated in a predetermined rotational direction at a predetermined peripheral speed, the photosensitive drum having a peripheral surface capable of forming a latent static electric image; and a developing roller disposed in confrontation with the photosensitive drum and for developing a latent static electric image formed on the peripheral surface of the photosensitive drum into a toner image, the developing roller being rotated in the rotational direction at a peripheral speed not more than two times the predetermined peripheral speed.

14 Claims, 8 Drawing Sheets

IMAGE FORMING DEVICE HAVING A PHOTOSENSITIVE DRUM AND DEVELOPING ROLLER THAT ROTATE IN THE SAME DIRECTION

BACKGROUND OF THE INVENTION

1. Field of the Invention

The present invention relates to a type of image forming device used in, for example, laser printers, facsimile machines, and copy machines wherein a developing roller covered with toner and a photosensitive drum in contact with the developing roller are driven to rotate so that the toner on the developing roller develops a latent static electric image on the surface of the photosensitive drum.

2. Description of the Related Art

There has been known a type of image forming device used in laser printers, and copy machines, and the like. The image forming device includes a sheet-supply mechanism using a sheet-supply roller to supply one sheet at a time from a stack of sheets contained in a sheet-supply cassette; a photosensitive drum; a laser scanner unit for forming a latent static electric image on the surface of the photosensitive drum; a developing unit for developing the latent static electric image on the surface of the photosensitive drum; a transferring unit; and a fixing unit. This type of image forming device is capable of forming a variety of toner images on the surface of sheets supplied by the sheet-supply mechanism.

FIG. 1 shows an example of a conventional laser printer 200. Typically, a sheet-supply cassette 214 containing sheets of paper P and a sheet-supply roller 213 for feeding one sheet at a time of the sheets in the sheet-supply cassette 214 are provided near the base of a case 202 of the laser printer 200. A photosensitive drum 220 and a transfer roller 260 disposed beneath the photosensitive drum 220 and in pressing contact therewith are provided above the sheet-supply cassette 214 and the sheet-supply roller 213. A fixing unit 270 is provided adjacent to the photosensitive drum 220. A sheet-discharge tray 277 is provided above the photosensitive drum 220. As indicated by a one-dot chain line in FIG. 1, sheets P supplied from the sheet-supply cassette 214 are transported along a sheet-transport pathway PP, which switches back on itself several times in a zigzag pattern. This configuration allows forming the laser printer 200 in a compact size.

To form an image on a sheet P, a charge-removing lamp 241 first removes any latent charge from the surface of the photosensitive drum 220. Then, a charger 240 forms a uniform charge in a predetermined polarity on the surface of the photosensitive drum 220. A laser scanner unit 230 is controlled to emit a laser light L to irradiate desired positions on the surface of the photosensitive drum 220 and form a latent static electric image at the desired positions. A developing roller 256 provided integrally within a toner cartridge 250 contacts the photosensitive drum 220 so that charged toner from the toner cartridge 250 develops the latent static electric image into a visible toner image. The toner image is transferred onto a transported sheet P by the transfer roller 260. The toner image on the sheet P is fixed on the sheet P by a thermal roller 271 of the fixing unit 270. Finally, the sheet P with the image fixed thereon is discharged onto the discharge tray 277.

Along with the developing roller 256, a supply roller 255 in pressing contact with the developing roller 256 and for supplying toner 253 to the developing roller 256 is rotatably provided within the toner cartridge 250. A thickness-regulating blade 257 for regulating thickness of the layer of toner 253 adhering to the developing roller 256 in a predetermined thickness and for charging the toner 253 is provided in the toner cartridge 250. The thickness-regulating blade 257 is located so that excess toner 253 removed by the thickness-regulating blade 257 falls on the supply roller 255.

The developing roller 256 and the supply roller 255 are driven to rotate in the same direction as indicated by arrows in FIG. 1. The developing roller 256 rotates in pressing contact with the photosensitive drum 220 in a rotational direction different from the rotational direction of the photosensitive drum 220 so that the toner 253 is statically charged to a predetermined polarity while developing the latent static electric image on the surface of the photosensitive drum 220.

However, with this type of laser printer 200, envelopes or other types of thick sheet P are difficult to smoothly transport along the sheet-transport pathway PP because of its zigzag configuration. Therefore, this type of laser printer 200 is best suited to forming images on thin sheets of flexible material.

Recently, a laser printer for forming images on thick types of sheets has been put into practical application. In this type of laser printer, the sheet-transport pathway from the sheet-supply cassette to the discharge tray is substantially linear.

In an example shown in FIG. 2, a photosensitive drum 320, a transfer roller 360, and a fixing unit 370 are provided along a substantially linear sheet-transport pathway PP from a sheet-supply cassette 314 to a sheet-discharge tray 377. A toner cartridge 350 is provided upstream in the sheet-transport direction from the photosensitive drum 320. Also, a developing roller 356 and a supply roller 355 provided in the toner cartridge 350 are arranged and driven to rotate indicated by arrows in FIG. 2 so that excess toner 353 removed by a thickness-regulating blade 357 falls onto the supply roller 355. In order to develop a latent static electric image on the surface of the photosensitive drum 320 into a sufficiently dense image, the developing roller 356 is rotated in the same rotational direction as, and at 2.4 times the peripheral speed of, the rotational direction and the peripheral speed of the photosensitive drum 320. This configuration provides a substantially linear sheet-transport pathway PP and also allows providing the charge removing light 341, the charger 340, and the laser scanner unit 330 at positions upstream in the rotational direction of the photosensitive drum 320 with respect to the toner cartridge 350.

SUMMARY OF THE INVENTION

However, in a laser printer configured as shown in FIG. 2, the sheet-supply cassette 314, the photosensitive drum 320, the transfer roller 360, the fixing unit 370, and the discharge tray 377 are provided along a substantially linear transport pathway PP so that thick sheets can be printed on; the photosensitive drum 320 is driven to rotate in the clockwise direction as viewed in FIG. 1 in order to transport a sheet P between the photosensitive drum 320 and the transfer roller 360 in pressing contact with the photosensitive drum 320; the developing roller 356 is rotated in the same clockwise direction as the photosensitive drum 320 so that excessive toner removed by the thickness-regulating blade 357 falls on the supply roller 355; and the developing roller 356 is rotated with a predetermined peripheral speed about 2.4 times the peripheral speed of the photosensitive drum 320. Therefore, the outer peripheral portion of the photosensitive drum 320 and the outer peripheral portion of the developing roller 356 move in opposite directions and at a high speed relative to each other at the portion where they contact. This creates a great deal of friction between the photosensitive drum 320 and the developing roller 356. For example, after 3,000 or 4,000 sheets P are printed on, image quality can drop to the point where the toner cartridge 350, the photosensitive drum 320, or both need to be replaced with new ones. This increases running costs of the laser printer.

It is conceivable to configure a printer as shown in FIG. 3 so that a developing roller and photosensitive drum rotate in the opposite directions in order to lengthen the life of the toner cartridge and the photosensitive drum. As can be seen in FIG. 3, a sheet-supply cassette 414 is provided with a supply roller 413. Sheets P are transported along a substantially linear sheet-transport pathway PP from the supply roller 413 to a discharge tray 477. A photosensitive drum 420 and a transfer roller 460 are disposed on opposite sides of and at the center of the sheet-transport pathway PP. That is, the photosensitive drum 420 is disposed below the sheet-transport pathway PP and the transfer roller 460 is disposed above the sheet-transport pathway PP. A fixing unit 470 is provided sandwiching the sheet-transport pathway PP at a position downstream from the photosensitive drum 420 in a sheet-transport direction. A toner cartridge 450 including a developing roller 456 is disposed upstream from the photosensitive drum 420. Further, a thickness-regulating blade 457 for removing excess toner 453 from the developing roller 456 is provided in the toner cartridge 450. The developing roller 456, the supply roller 455, and the photosensitive drum 420 are driven to rotate as shown in FIG. 3 so that toner removed by the thickness-regulating blade 357 falls on the supply roller 455. As mentioned above, the developing roller 456 is driven to rotate in the opposite rotational direction from that of the photosensitive drum 420. However, with this configuration, it is virtually impossible to dispose other components, such as a charge removing lamp, a charger, and a laser scanner unit, in the narrow space between the sheet-transport pathway PP and the toner cartridge 450.

It is an objective of the present invention to overcome the above-described problems and provide an image forming device with a minimum amount of abrasion between a photosensitive drum and a developing roller, which rotates in pressing contact with the photosensitive drum, and with a substantially linear sheet-transport pathway so that images can be formed on thick sheets such as envelopes.

In order to achieve the above-described objective, an image forming device according to the present invention for forming images on a sheet transported along a sheet-transport pathway from a sheet supply means to a sheet discharge means includes a photosensitive drum rotated in a predetermined rotational direction at a predetermined peripheral speed, the photosensitive drum having a peripheral surface capable of forming a latent static electric image; and a developing roller disposed in confrontation with the photosensitive drum and for developing a latent static electric image formed on the peripheral surface of the photosensitive drum into a toner image, the developing roller being rotated in the rotational direction at a peripheral speed not more than two times the predetermined peripheral speed.

According to another aspect of the present invention, an image forming device includes a feeder unit including a sheet-supply roller for supplying sheets on which are to be formed images; a photosensitive drum having a surface on which can be formed latent static electric images; an exposure means for forming a latent static electric image on the surface of the photosensitive drum; a developing unit including a developing roller in confrontation with the photosensitive drum and for developing the latent static electric image on the surface of the photosensitive drum into a toner image; a transferring means for transferring the toner image from the photosensitive drum onto a sheet supplied by the feeder unit; a fixing unit for thermally fixing the toner image onto the sheet; a discharge means for discharging the sheet from the image forming device; a first drive means for driving the photosensitive drum to rotate in a predetermined rotational direction at a predetermined peripheral speed in synchronization with a supply of sheets; and a second drive means for driving the developing roller of the developing unit to rotate in the predetermined rotational direction at at most two times the predetermined peripheral speed of the photosensitive drum.

BRIEF DESCRIPTION OF THE DRAWINGS

The above and other objects, features and advantages of the invention will become more apparent from reading the following description of the preferred embodiment taken in connection with the accompanying drawings in which.

DETAILED DESCRIPTION OF THE PREFERRED EMBODIMENTS

Figure 1:
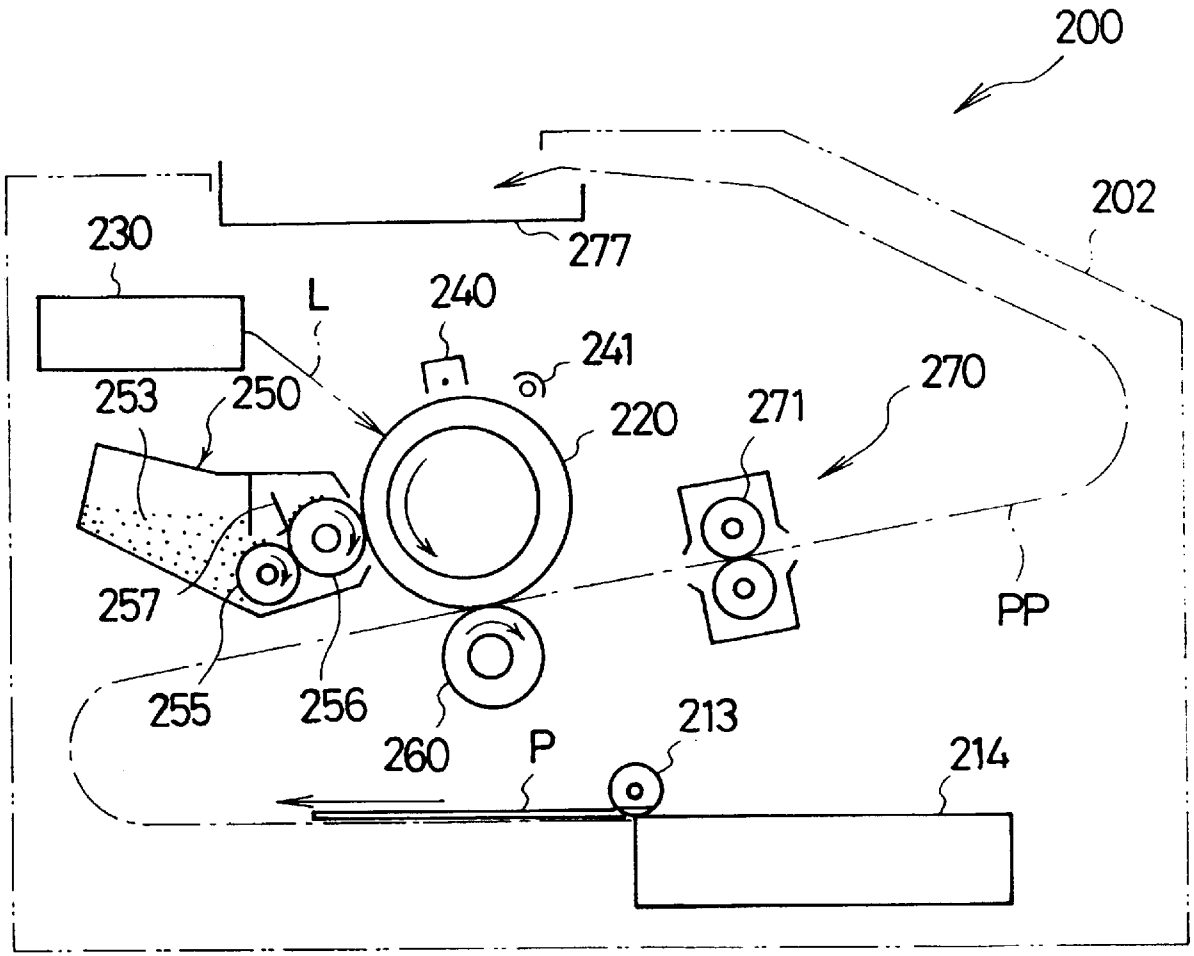
FIG. 1 PRIOR ART
FIG. 1 is a side view in cross section showing a conventional laser printer with a zigzag shaped sheet-transport pathway.
Figure 2:
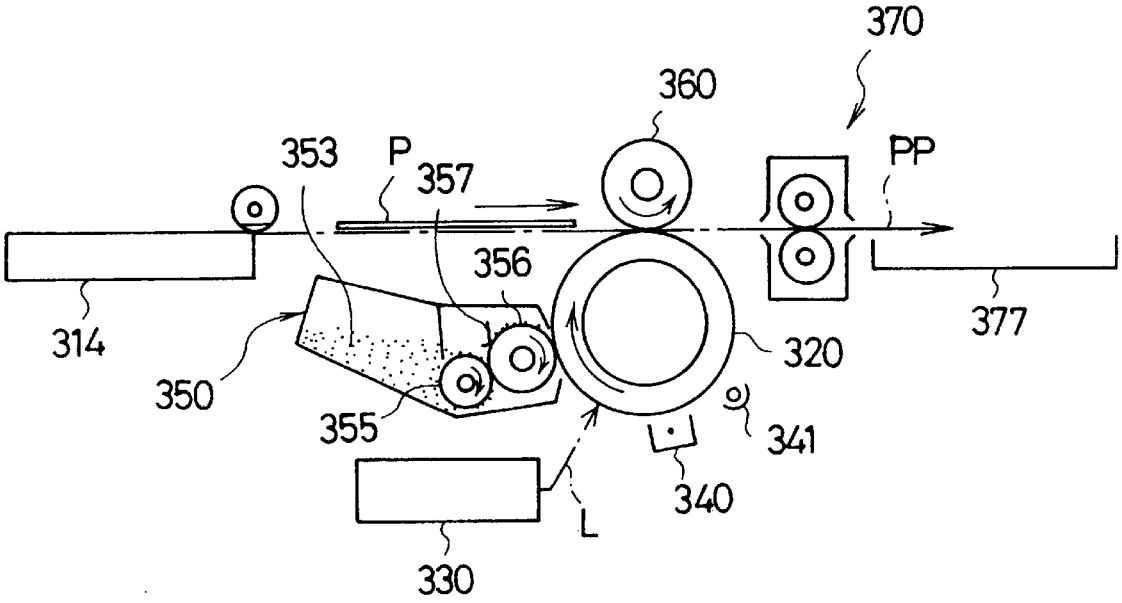
FIG. 2 PRIOR ART
FIG. 2 is a side view in cross section showing a conventional laser printer with a linear shaped sheet-transport pathway.
Figure 3:
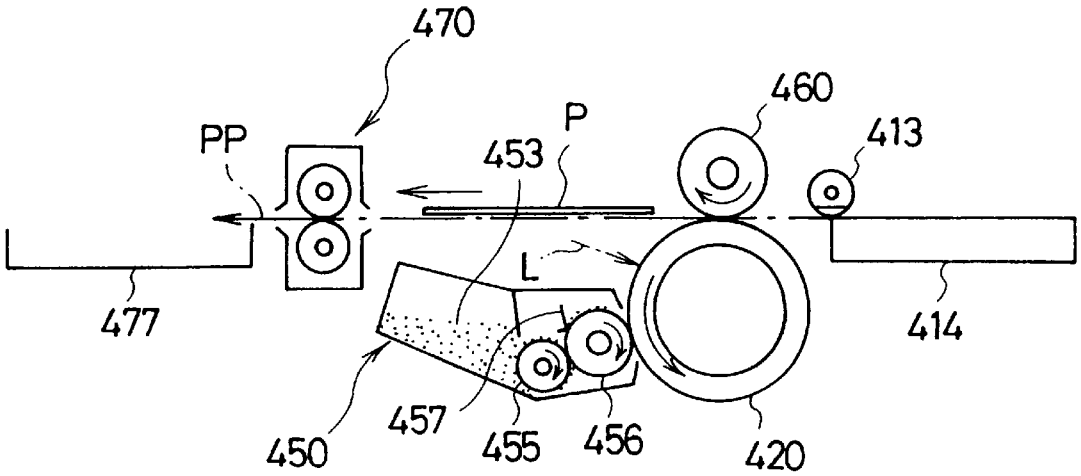
FIG. 3 is a side view in cross section showing a conceivable laser printer with a linear shaped sheet-trans-port pathway.

A laser printer including an image forming device according to a preferred embodiment of the present invention will be described while referring to the accompanying drawings wherein like parts and components are designated by the same reference numerals to avoid duplicating description. Unless otherwise noted, terms such as above, below, front, rear, left, and right describing relative positions of components will be used assuming that the laser printer is in an orientation in which it is intended to be used.

Figure 4:
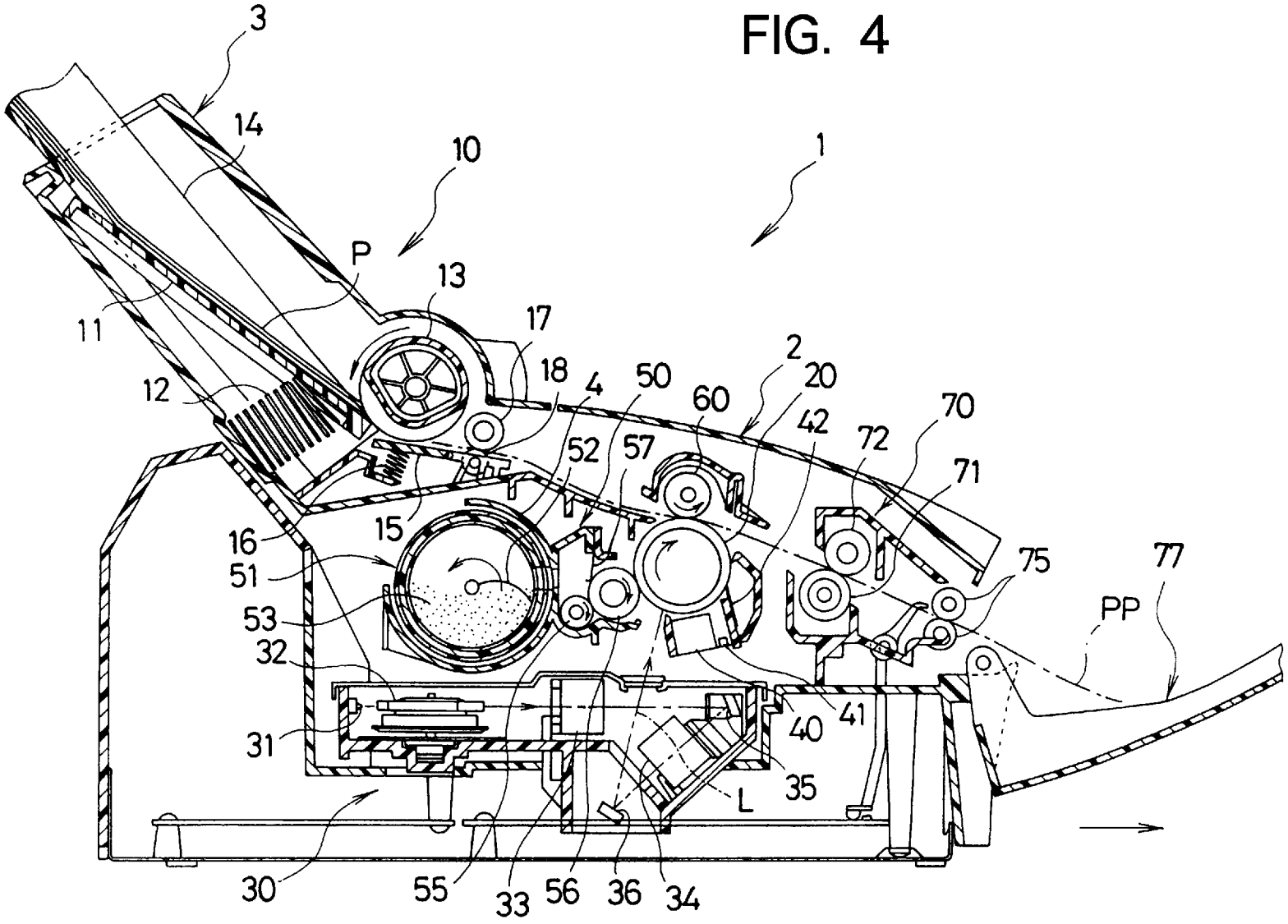
FIG. 4 is a cross-sectional view showing a laser printer including an image forming device according to the present invention.

The present embodiment describes the present invention applied to a laser printer including a feeder unit, a photosensitive drum, a laser scanner unit, and other components to be described below. As shown in FIG. 4, a laser printer 1 according to the present invention includes a case 2 housing a feed unit 10 for supplying sheets P on which images are to be formed; a photosensitive drum 20 for receiving laser light L; a laser scanner unit 30 for irradiating the photosensitive drum 20 with the laser light L and forming latent static electric images on the surface of the photosensitive drum 20; a developing unit 50 having a developing roller 56; a transfer roller 60 for transferring toner images from the surface of the photosensitive drum 20 onto a sheet P; a fixing unit 70; and a discharge tray 77 onto which sheets P with images formed thereon are discharged. As will be described later, the laser printer 1 also includes a first drive mechanism 80 for driving the photosensitive drum 20 and a second drive mechanism 100 for driving the developing roller 56 and other components.

First, an explanation will be provided for the feed unit 10. As shown in FIG. 4, the feed unit 10 includes a feeder portion case 3 disposed at the upper rear end of the case 2. A sheet-pressing plate 11 having a width substantially the same as the width of sheets P is supported within the feeder portion case 3 so as to be swingable with respect to the rearmost edge of the case 2. A compression spring 12 for resiliently urging the pressing-plate 11 upward is disposed at the front-most edge of the case 3. A sheet-supply roller 13 extending rightward and leftward, that is, in the direction perpendicular to the surface of FIG. 1, is supported so as to be freely rotatable. A drive system (not shown in the drawings) drives the sheet-roller 13 to rotate at a timing for supplying sheets.

A sheet-cassette 14 capable of housing a plurality of stacked sheets cut into a predetermined shape is detachably mounted at a slant in the case 3. Rotation of the sheet-supply roller 13 supplies one sheet at a time of the sheets P contained in the sheet-supply cassette 14. A separation member 15 for preventing two sheets from being supplied at the same time is provided below the sheet-supply roller 13. A compression spring 16 is provided for resiliently urging the separating member 15 against the sheet-supply roller 13. A pair of resist rollers 17, 18 for aligning the front edge of supplied sheets P is rotatably provided downstream in a sheet-transport direction, that is, from the left to the right as viewed in FIG. 4, from the sheet-supply roller 13.

Figure 5:
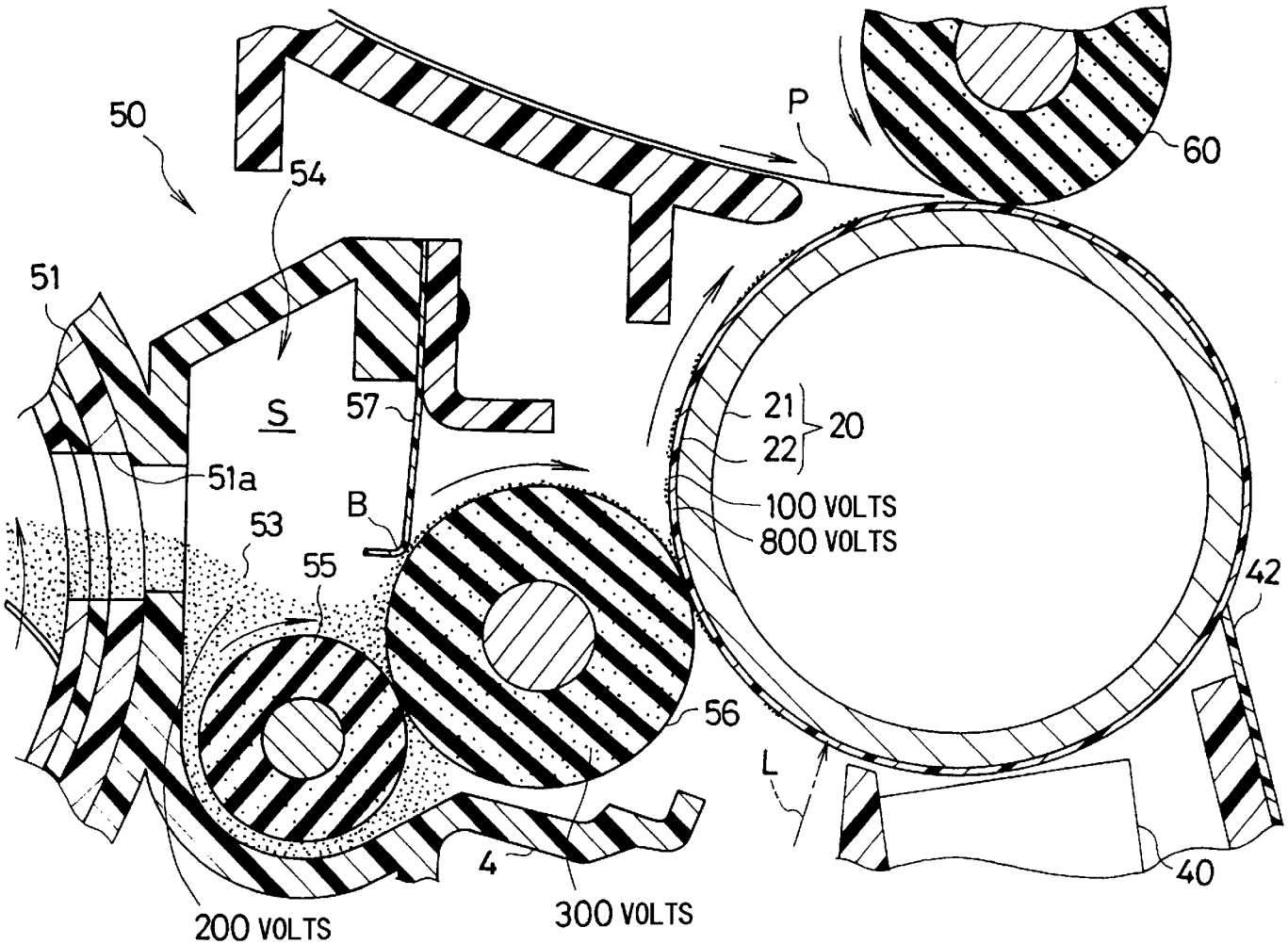
FIG. 5 is a magnified view of FIG. 4 showing details of the image forming device, particularly a photosensitive drum, a developing roller, and surrounding components in the vicinity of the photosensitive drum and the developing roller.
Figure 6:
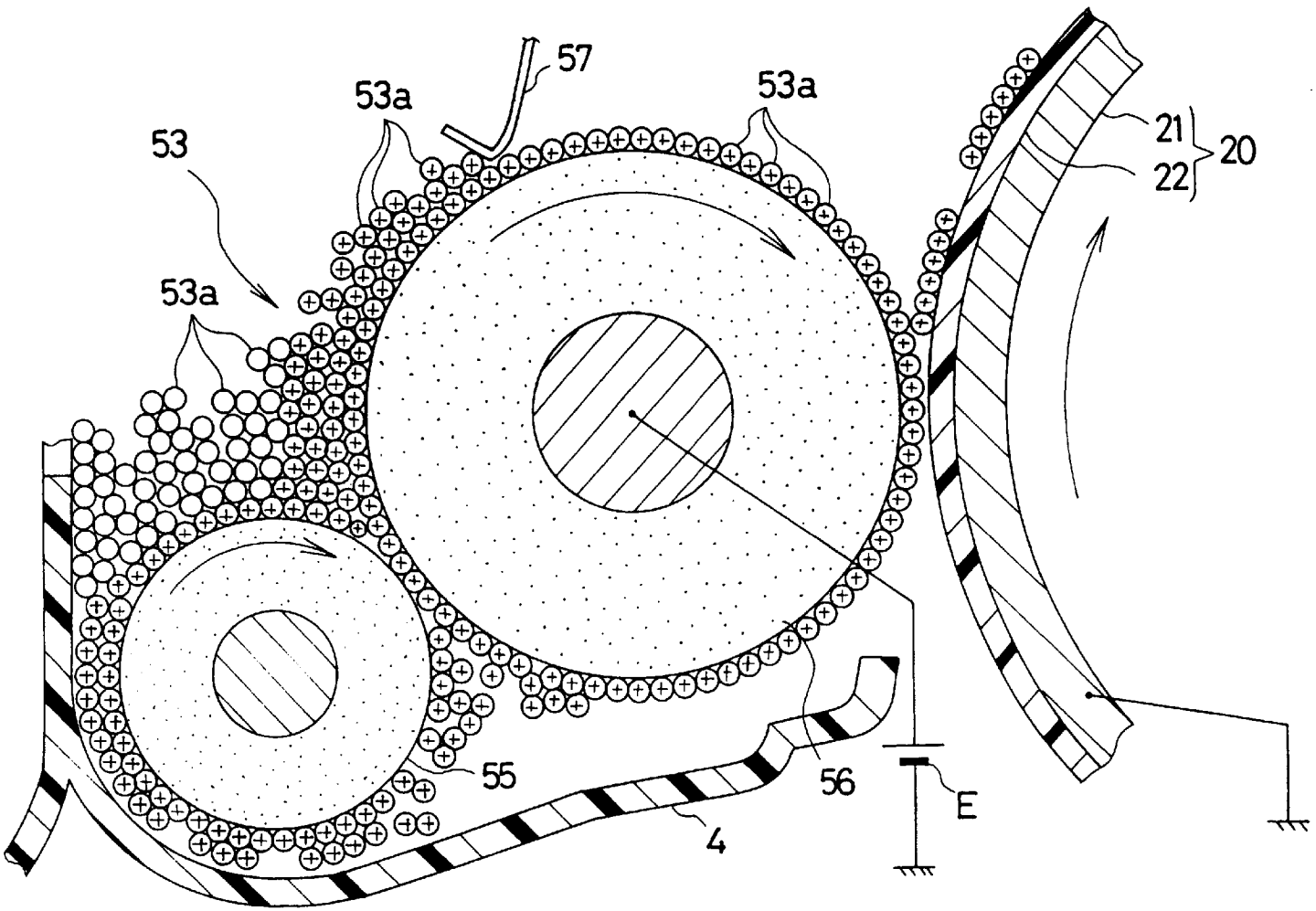
FIG. 6 is a magnified view of FIG. 5 showing details of the photosensitive drum and the developing roller.

As shown in FIGS. 4, 5, and 6, the photosensitive drum 20 includes a hollow cylindrical aluminum sleeve 21 and a photoconductive layer 22 formed to a predetermined thickness, for example, about 20 $\mu$m to the outer peripheral surface of the sleeve 21. The photoconductive layer 22 includes a photoconductive resin dispersed in a polycarbonate. The sleeve 21 is rotatably mounted on the case 2 in a grounded condition. With this configuration, developing is possible by reversal development wherein positively charged toner 53 develops a positively charged latent static electric image formed on the surface of the photosensitive drum 20.

The laser scanner unit 30 is disposed below the photosensitive drum 20 and includes a laser emitting unit 31 for generating the laser light L to form latent static electric images on the surface of the photosensitive drum 20; a five-sided polygon mirror 32 driven to rotate; a pair of lenses 33, 34; a pair of reflection mirrors 35, 36; and other components. Because the laser scanner unit 30 is disposed below the photosensitive drum 20, the length of the image forming device in the sheet-transport direction can be reduced so that the laser printer 1 can be provided in a more compact size. Also, the laser scanner unit 30 can emit the laser light L to form a latent static electric image on the surface of the photosensitive drum 20 without interference from the sheets transported in the sheet-transport pathway PP.

A scorotron type charger unit 40 for generating a corona discharge from a tungsten charge wire is disposed adjacent to the photosensitive drum 20 at a position upstream from, with the respect to the rotational direction of the photosensitive drum 20, a position where the laser light L irradiates the photosensitive drum 20. A charge-removing lamp 41 is provided at a position upstream from the charge unit 40. A paper powder removing blade 42 for removing paper powder from the surface of the photosensitive drum 20 is provided in pressing contact with the photosensitive drum 20 at a position upstream from the charge removing lamp 41.

Next, an explanation will be provided for a developing unit 50 disposed directly to the rear of the photosensitive drum 20. A double-cylindrical toner box 51 is detachably mounted within a developing case 4. An agitator 52 driven to rotate and toner 53 having electrical isolation properties are contained in the toner box 51. A toner-supply port 51*a* is formed in the front edge of the toner box 51. A toner-storage chamber 54 for storing toner 53 supplied through the toner-supply port 51a by rotation of the agitator 52 is formed to the front side of the toner box 51. A toner-supply roller 55 is rotatably supported in the toner-storage chamber 54 so as to extend horizontally in the leftward and the rightward directions, that is, the direction perpendicular to the surface of FIG. 4. A developing roller 56 is rotatably supported in contact with both the supply roller 55 and the photosensitive drum 20 and so as to extend horizontally in the leftward and the rightward directions so as to form a front wall of the toner-storage chamber 54.

The toner 53 is a polymerized toner formed from styreneacryl in a shape more spherical than pulverized toner. Individual particles of the toner 53 have a diameter of between 7 to 10 $\mu$m. The toner 53 is dusted with a silica or other agent to reduce its friction producing characteristics and to prevent it from cohering.

The supply roller 55 is formed from silicone rubber, urethane rubber, or some other resilient material having electrical conductive properties. The resistance value of the supply roller 55 where it contacts the developing roller 56 is set between about $5\times10^4$ to $1\times10^9\Omega$.

Further, the developing roller 56 is formed from a silicone rubber, a urethane rubber, or other resin material having electrical conductive properties. The developing roller 56 must have a high adhesive force at its outer peripheral surface and so should not be Teflon coated. Contrarily, its outer peripheral surface should be processed to increase adhesive force. The resistance value from the core electrode, which is applied with a developing bias voltage, to the outer peripheral surface in contact with the photosensitive drum 20 is set to about $5\times10^4$ to $1\times10^7\Omega$.

The toner-storage chamber 54 is formed with a relatively large open space S above the supply roller 55. As shown in FIG. 5, even when a great deal of toner 53 is supplied from the toner box 51 through the toner-supply port 51*a* into the toner-storage chamber 54, toner 53 will not clog up the toner-supply port 51*a* or become compressed in the toner-storage chamber 54. Therefore, the toner 53 will constantly be in a fluffed condition which is sufficiently fluid in nature. This allows the supply roller 55 to stably supply toner.

A resilient thickness-regulating blade 57 formed in a thin-plate shape from stainless steel or phosphor bronze is dependingly attached to the developing case 4. The thickness-regulating blade 57 is in pressing contact with the developing roller 56 at its lower-most tip. The lower-most tip is bent away from the developing roller 56. The thickness-regulating blade 57 regulates thickness of toner 53 supplied from the supply roller 55 and adhering in a layer to the surface of the developing roller 56 to a predetermined thickness of one particle thickness or greater, that is, to about 7 to 12 $\mu$m thick, which is equivalent to about 0.4 mg/cm$^2$. The bent portion B has a radius of curvature of about 0.3 mm to insure a toner amount of 0.4 mg/cm$^2$.

Image force is inversely proportional to the square of the distance. Therefore, the image force acting on toner 53 in a second layer is extremely weak so that any toner 53 in a second layer on the developing roller 56 would only be weakly held in place and could easily accumulate between the photosensitive drum 20 and the developing roller 56. Because the thickness-regulating blade 57 regulates the thickness of the toner 53 on the surface of the developing roller 56 to only about one particle thickness or slightly greater, toner 53 not used in developing the latent static electric image on the surface of the photosensitive drum 20 will be held tightly to the surface of the developing roller 56 by image forces so it can be reliably collected thereafter.

As will be described in greater detail later, the first drive mechanism 80 drives the photosensitive drum 20 and other components to rotate in the clockwise direction as viewed in FIGS. 4, 5, and 6. Also, the second drive mechanism 100 drives the supply roller 55 and the developing roller 56 to also rotate in the clockwise direction. With this configuration, the supply roller 55 and the developing roller 56 scrape against each other as shown in FIG. 5. Also, the thickness-regulating blade 57 pressingly abrades against the developing roller 56. The scraping and abrading action positively charges individual toner particle 53*a* of the individual toner particles 532. The positively charged toner 53 adheres to the latent static electric image formed on the surface of the photosensitive drum 20 by the laser light L, thereby developing the static electric image by reversal development.

The transfer roller 60 is freely rotatably disposed above and in contact with the photosensitive drum 20. The transfer roller 60 is formed from silicone rubber, urethane rubber, or other resilient foam body having electrical conductive properties. The resistance value where the transfer roller 60 contacts the photosensitive drum 20 is set to a large value of about $1\times10^6$ to $1\times10^{10}\Omega$ so that even though the transfer roller 60 contacts the surface of the photosensitive drum 20, the voltage applied to the transfer roller 60 will flow evenly through the photoconductive layer 22 formed to the surface of the photosensitive drum 20 instead of concentrating at pinholes in the photoconductive layer 22. This prevents damage to the photo-conductive layer 22. Further, the toner image on the surface of the photosensitive drum 20 can be reliably and accurately transferred to the sheet P.

The fixing unit 70 is provided downstream in the sheet-transport direction from the photosensitive drum 20. The fixing unit 20 includes a thermal roller 71 and a pressing roller 72. A halogen lamp is provided internally to the thermal roller 71. A sheet P with a toner image transferred onto its lower surface is heated and pressed between the thermal roller 71 and the pressing roller 72 so that the toner image is fixed onto the sheet P. A pair of transport rollers 75 and the discharge tray 77 are provided downstream in the sheet-transport direction from the fixing unit 70. As shown in FIG. 4, the sheet-supply roller 13, the photosensitive drum 20, the fixing unit 70, and the discharge tray 77 form a substantially linear sheet-transport pathway PP along which sheets P supplied from the sheet-supply cassette 14 are transported.

Figure 7:
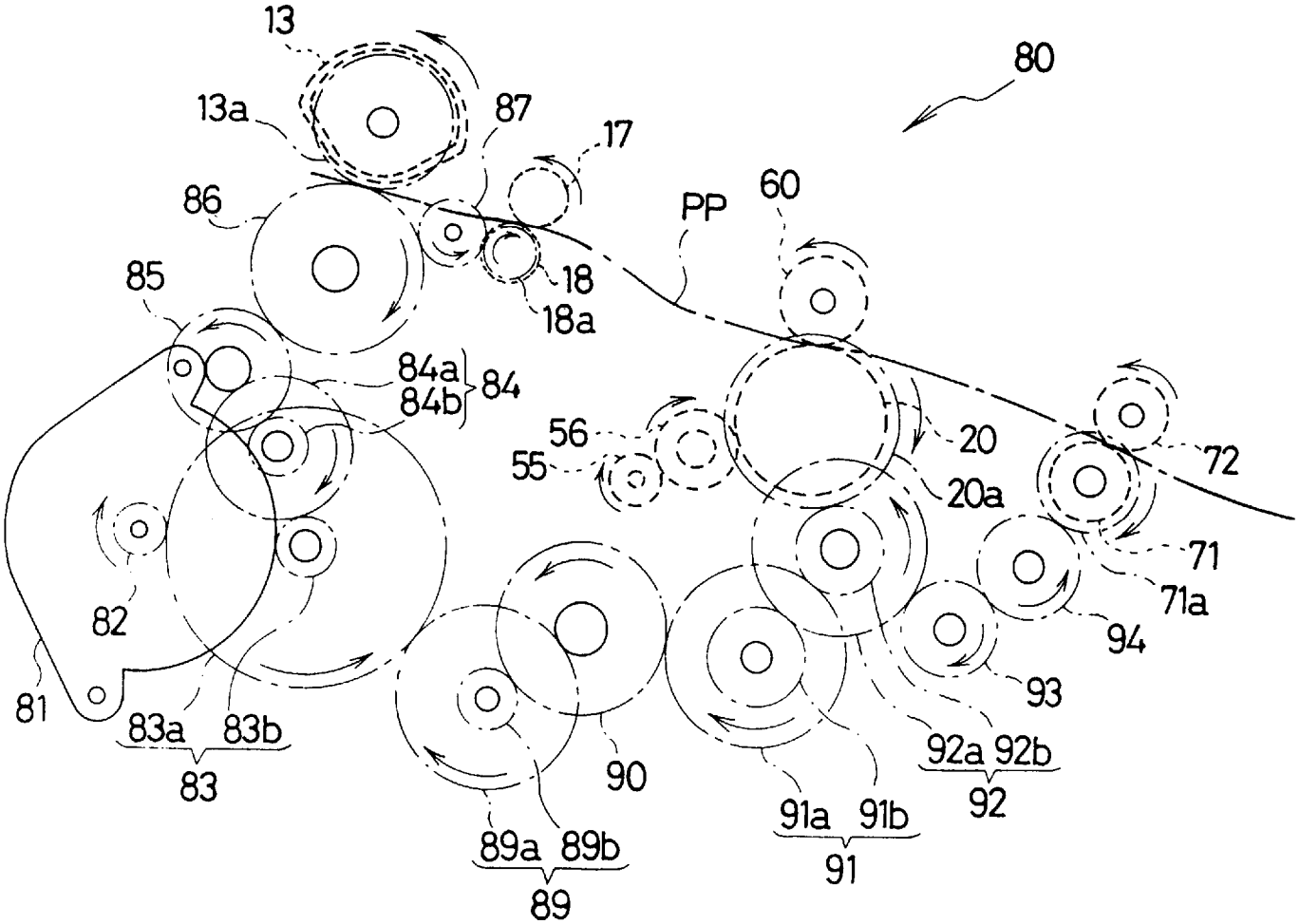
FIG. 7 is a side view showing a first drive mechanism for driving rotation of the photosensitive drum.

Next, the first drive mechanism 80 according to the present invention for driving the photosensitive drum 20 and other components for transporting sheets P will be described while referring to FIG. 7. The first drive mechanism 80 is disposed at the outward facing surface of the left side wall of the laser printer 1. A first drive motor 81 is provided with a gear 82 disposed on the tip of its drive output shaft. Rotational force of the gear 82 is transmitted to a gear 85 via a two-speed gear 83 including gears 83*a*, 83*b* and a two-speed gear 84 including gears 84*a*, 84*b*. Rotational force of the gear 85 is transmitted via a gear 86 to a gear 13*a* for driving the sheet-supply roller 13. Further, rotational force of the gear 86 is transmitted via a gear 87 to a gear 18*a* for driving the resist roller 18.

Rotational force of the two-speed gear 83 is transmitted via a two-speed gear 89 including gears 89*a*, 89*b*, a gear 90, a two-speed gear 91 including gears 91*a*, 91*b*, and a two-speed gear 92 including gears 92*a*, 92*b* to a gear 20*a* for driving the photosensitive drum 20.

Rotational force of the two-speed gear 92 is transmitted via a gear 93 and a gear 94 to a gear 71*a* for driving the thermal roller 71. That is, when the first drive motor 81 rotates in the clockwise direction as viewed in FIG. 7, the sheet-supply roller 13, the pair of resist rollers 17, 18, the photosensitive drum 20, and the thermal roller 71 are driven to rotate in directions indicated by arrows in FIG. 7. Therefore, sheets P supplied from the sheet-supply cassette 14 are transported along the predetermined sheet pathway PP and discharged onto the discharge tray 77.

Figure 8:
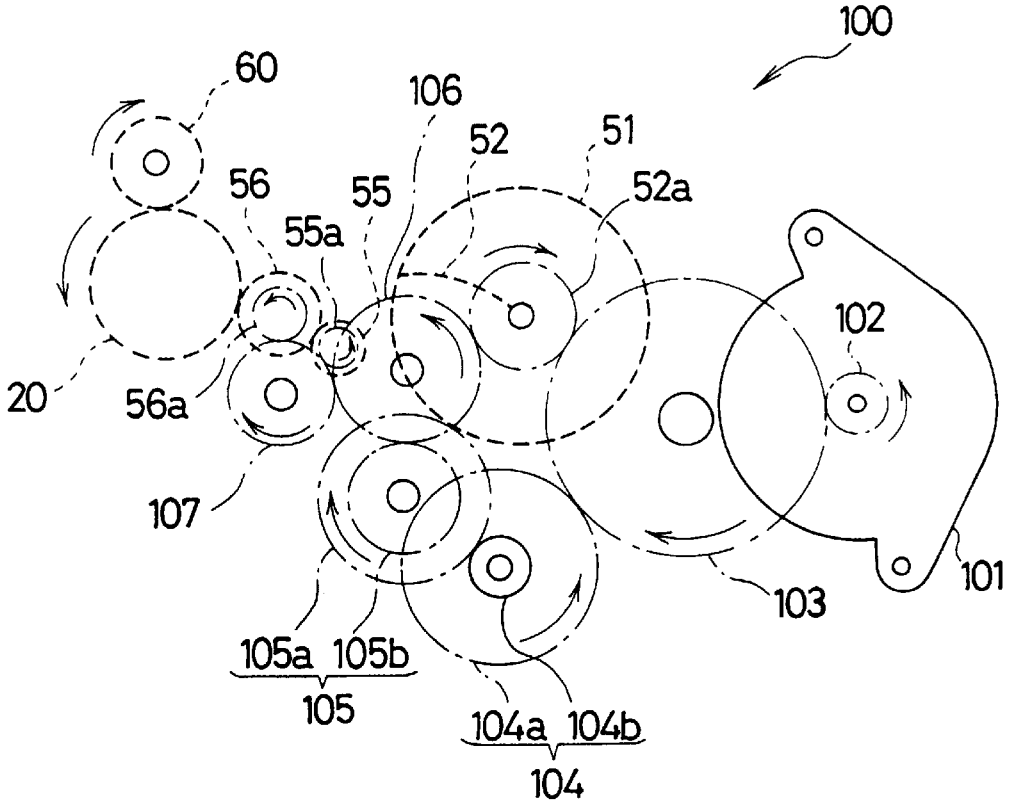
FIG. 8 is a side view showing a second drive mechanism for driving rotation of the developing roller.

Next, the second drive mechanism 100 according to the present invention for driving the developing unit 50 while referring to FIG. 8. The second drive mechanism 100 is disposed to the outer-right side of the laser printer 1 and includes a second drive motor 101 with a gear 102 attached to its output shaft. Rotational force of the gear 102 is transmitted via a gear 103, a two-speed gear 104 including gears 104*a*, 104*b*, a two-speed gear 105 including gears 105*a*, 105*b*, and a gear 106 to a gear 52*a* for driving the agitator 52 housed in the toner box 51. Rotational force of the gear 106 is transmitted via a gear 107 to a gear 56*a* for driving the developing roller 56 and to a gear 55*a* for driving the supply roller 55.

With this configuration, when the second drive motor 101 is driven to rotate in the counter-clockwise direction as viewed in FIG. 8, the agitator 52, the supply roller 55, and the developing roller 56 are driven to rotate in directions indicated by arrows in FIG. 4. Therefore, rotation of the agitator 52 supplies toner 53 from the toner box 51 to the supply roller 55. Also, rotation of the supply roller 55 supplies toner 53 to the developing roller 56. It should be noted that the photosensitive drum 20, the developing roller 56, and the supply roller 55 are driven to rotate in the same direction. Also, the developing roller 56 is driven at the predetermined peripheral speed two times or less the peripheral speed of the photosensitive drum 20.

Figure 11:
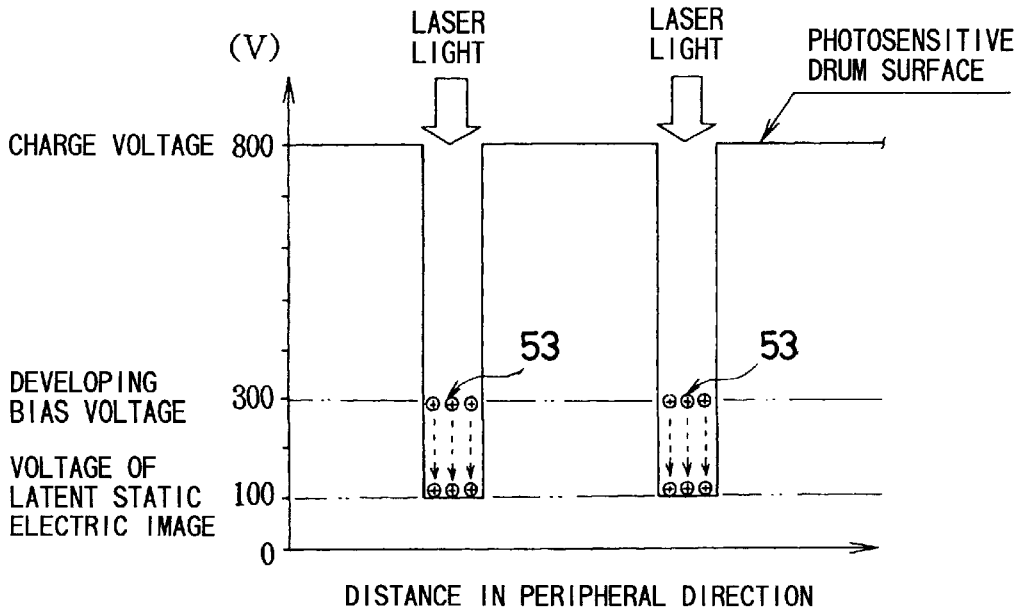
FIG. 11 is a graphical representation of processes according to reversal development.

While referring to FIGS. 9, through 11 a set of development conditions for performing development processes by reversal development according to the present invention will be explained. In this explanation, it will be assumed that a transmission density of 2.0 is required for forming a sufficiently dense toner image. Transmission density is determined by irradiating light on the rear surface of a sheet covered with a toner layer and by measuring the amount of light transmitted through to the front surface of the sheet and the toner layer. The transmission density is represented by the following equation:

transmission density=$\log_{10}$ (incident light/transmitted light).

Figure 9:
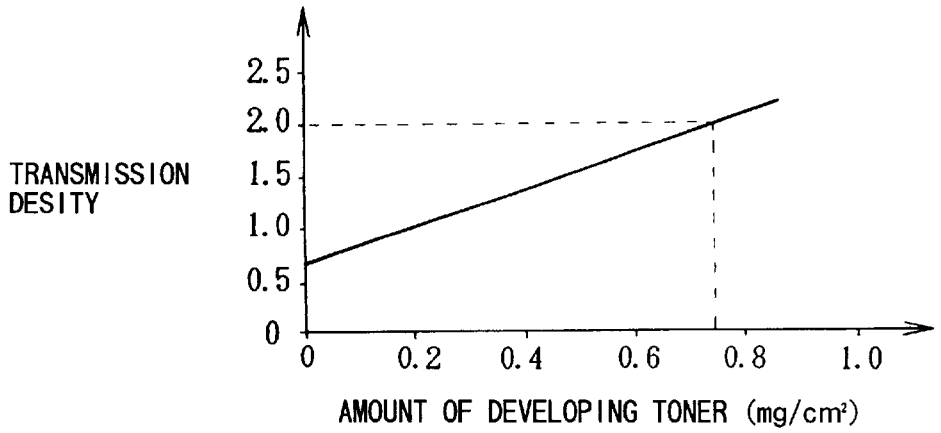
FIG. 9 is a graph showing relationship between transmission density and amount of toner of a recorded image.

As shown in FIG. 9, in order to obtain a transmission density of 2.0, the amount of toner adhering to the surface of the sheet needs to be about 0.78 mm/cm$^2$. It should be noted that when the thickness-regulating blade 57 regulates the toner amount on the developing roller 56 to 0.4 mg/cm$^2$ as described above, a development efficiency of about 100 percent can be achieved and also a slight amount of toner 53 can be retained on the surface of the developing roller 56 by adhesive force to avoid direct contact between the developing roller 56 and the photosensitive drum 20. Developing efficiency is determined by dividing the amount of developed toner by amount of transported toner. In actual measurements, the amount of toner on the developing roller 56 before and after the nip is measured and applied to the following formula:

Developing efficiency={1−(toner amount after nip)/(toner amount after nip))}×100.

Figure 10:
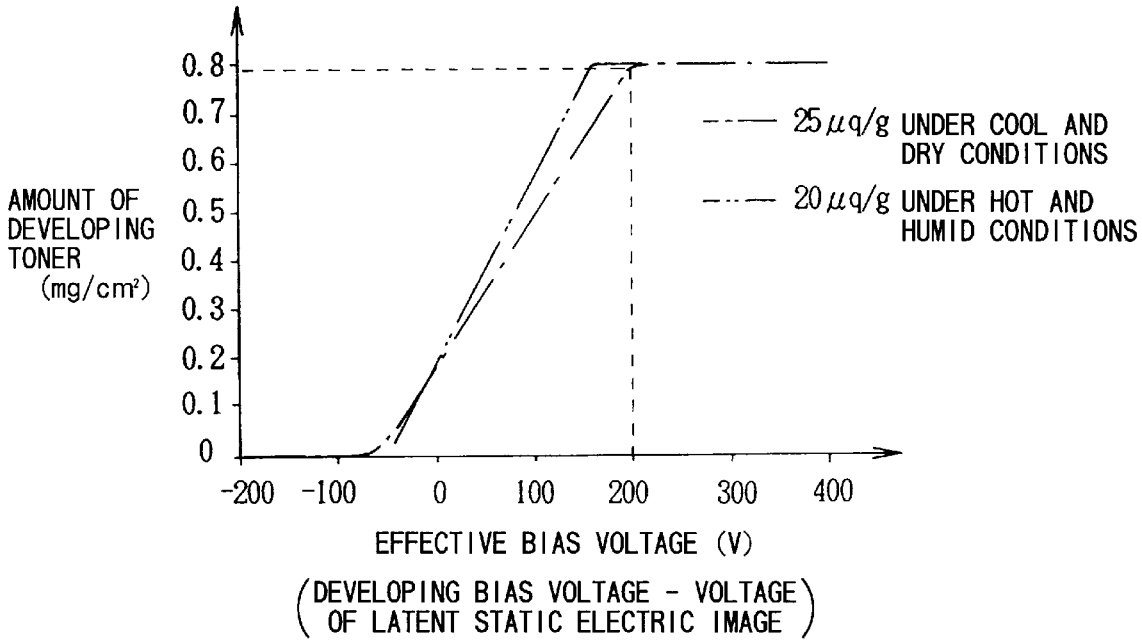
FIG. 10 is a graph showing relationship between amount of toner of a recorded image and an effective bias voltage applied to the developing roller at extreme ambient environmental conditions.

The charge amount of toner 53 varies depending on the temperature and humidity of the ambient environment. For example, in a low temperature and a low humidity environment of 10 degrees C and 20 percent humidity, the charge amount can be about 25 $\mu$q/g. This can decrease to about 20 $\mu$q/g at high temperature and high humidity conditions of about 32 degrees C and 80 percent humidity. As described above, the developing roller 56 is driven in the same rotational direction as, and at a peripheral speed of two times or less than the photosensitive drum 20. As shown in FIG. 10, to obtain the predetermined developing toner amount of approximately 0.78 mg/cm$^2$ in the low temperature and low humidity environment as indicated by the one-dot chain line or the high temperature and high humidity environment as indicated by the two-dot chain line, the effective developing bias voltage of the developing roller 56 needs to be set to about 200 volts. Because the voltage of the latent static electric image formed on the surface of the photosensitive drum 20 is 100 volts, as indicated in FIG. 5, setting the developing bias voltage of a power source E for applying voltage to the developing roller 56 to 300 volts, FIG. 5, will result in an effective developing bias voltage of 200 V.

When image forming processes are started, any charges remaining on the surface of the photosensitive drum 20 are removed by the charge removing lamp 41. Then, as shown in FIG. 11, the charger 40 applies a uniform charge of about 800 volts, FIG. 5, to the surface of the photosensitive drum 20. The laser emitting unit 31 emits a laser light L, which is scanned in a main scanning direction by the polygon mirror 32. The laser light L then irradiates the surface of the photosensitive drum 20, after passing through the lenses 33, 34 and reflecting off the reflecting mirror 35, 36, to form the latent static electric image on the surface of the photosensitive drum 20. Voltage developed at the surface of the photosensitive drum 20 formed with the latent static electric image drops to about 100 volts.

Because positively charged toner 53 is adhering in a thickness of about one particle or slightly greater to the surface of the developing roller 56 while a developing bias voltage of about positive 300 volts is applied to the developing roller 56, the toner 53 is attracted to the voltage lower then itself, that is, to the latent static electric image voltage, which is about positive 100 volts, rather than to the high charge voltage of about 800 volts at areas other than the latent static electric image. Therefore, the toner 53 from the developing roller 56 develops the latent static electric image formed on the surface of the photosensitive drum 20 at a developing efficiency of about 100 percent, thereby producing a sufficiently dense toner image.

Because the effective bias voltage of the developing roller 56 is set to about 200 volts, FIG. 5, which is not very large, and because a large adhesive force adheres the toner 53 to the developing roller 56, a small amount of toner 53 will be retained on the surface of the developing roller 56 by Van der Waals forces at conditions of low static electricity after developing processes even when the developing efficiency is about 100 percent. Further, the first drive mechanism 80 and the second drive mechanism 100 drive the developing roller 56 and the photosensitive drum 20 so that the developing roller 56 rotates with a predetermined peripheral speed of twice or less the peripheral speed of the photosensitive drum 20. Abrasion between the photosensitive drum 20 and the developing roller 56 is reduced by the residual toner 53 on the surface of the developing roller 56 and by the low peripheral speed of the developing roller 56. Therefore, the photosensitive drum 20 and the developing roller 56 can be used for a long period of time so that only the toner 53 need be replenished in the toner box 51 to continue developing processes. In this way, running costs can be reduced.

The toner image formed by developing the latent static electric image using toner 53 is transferred reliably to the sheet P by the transfer roller 60. Afterward, the toner image is fixed to the sheet P by the fixing unit 70 and discharged onto the discharge tray 77.

As mentioned above, the sheet-transport pathway PP through which a sheet P supplied from the sheet-supply cassette 14 is transferred is approximately linear in shape. Because the sheet P is transported through the substantially linear sheet-transport pathway PP, an accurate and clean toner image can be formed on thick sheets P such as envelopes and postcards.

While the invention has been described in detail with reference to specific embodiments thereof, it would be apparent to those skilled in the art that various changes and modifications may be made therein without departing from the spirit of the invention, the scope of which is defined by the attached claims.

For example, the second drive mechanism 100 can be configured to vary rotational speed of the developing roller 56 according to type of toner 53 and to the amount of toner adhering to the surface of the developing roller 56. Also, the first drive mechanism 80 and the second drive mechanism 100 can be driven by using the same drive source. The thickness-regulating blade 57 can be formed from a resilient rubber material. A charge roller can be used instead of the charges unit 40. Instead of the transfer roller 60, a transferring brush or corotron transferring unit can be used. It should be noted that the present invention can be applied to a variety of image forming devices used in copy machines, facsimile machines, and other devices.

Even though relative movement in opposite direction is developed between the photosensitive drum 20 and the developing roller 56 at the point where they come into pressing contact, because the peripheral speed of the developing roller 56 is equal to or less than two times the peripheral speed of the photosensitive drum 20, the amount of friction between the photosensitive drum 20 and the developing roller 56 can be reduced.

When the first drive mechanism 80 and the second drive mechanism 100 independently drive the photosensitive drum 20 and the developing roller 56 respectively, the peripheral speed of the developing roller 56 can be easily and freely set to equal to or less than two times the peripheral speed of the photosensitive drum 20. Rotational precision required by the photosensitive drum 20 can be maintained without being affected by the burden of also having to rotate the developing roller 56.

Because the sheets P supplied by the sheet-supply roller 13 are transported past the transfer roller 60 and the fixing unit 70 along a substantially linear sheet-transport pathway PP to be discharged by the transport rollers 75 onto the discharge tray 77, thick sheets P can be easily printed on.

Because the photosensitive drum 20 and the transfer roller 60 are disposed on opposite sides of the sheet-transport pathway PP, the sheet-transport pathway PP can be maintained in an approximately linear shape so that the toner images formed on the surface of the photosensitive drum 20 can be accurately transferred to the sheet P transported along the sheet-transport pathway PP. Because the scanner unit 30 is disposed below the photosensitive drum 20, that is, so as to sandwich the photosensitive drum 20 between itself and the sheet-transport pathway PP, the length of the image forming device in a sheet-transport direction can be shortened so that the image forming device can be formed in a more compact shape. Also, sheets P transported along the sheet-transport pathway PP will not interfere with exposure operations of the scanner unit 30 for forming latent static electric images on the surface of the photosensitive drum 20.

What is claimed is:

1. An image forming device for forming images on a sheet transported along a sheet-transport pathway from a sheet supply tray to a fixing unit, the image forming device comprising:

a photosensitive drum rotated in a predetermined rotational direction at a predetermined peripheral speed, the photosensitive drum having a peripheral surface capable of forming a latent static electric image; and a developing roller disposed in confrontation with the photosensitive drum and for developing a latent static electric image formed on the peripheral surface of the photosensitive drum into a toner image, the developing roller being rotated in the predetermined rotational direction at a peripheral speed not more than two times the predetermined peripheral speed.

2. An image forming device as claimed in claim 1, further comprising:

a first drive mechanism for driving the photosensitive drum to rotate in the predetermined rotational direction at the predetermined peripheral speed in synchronization with supply of sheets; and a second drive mechanism for driving the developing roller to rotate in the predetermined rotational direction at not more than two times the predetermined peripheral speed of the photosensitive drum.

3. An image forming device as claimed in claim 2, further comprising:

a first drive source for driving the first drive mechanism; and a second drive source for driving the second drive mechanism independently from the first drive mechanism.

4. An image forming device as claimed in claim 3, further comprising a transferring unit for transferring the toner image from the photosensitive drum onto the sheet supplied along the sheet-transport pathway, the transferring unit being disposed in confrontation with the photosensitive drum and opposite the photosensitive drum with respect to the sheet-transport pathway.

5. An image forming device as claimed in claim 4, further comprising an exposure unit disposed opposite the transferring unit with respect to the photosensitive drum.

6. An image forming device as claimed in claim 1, further comprising a transferring unit for transferring the toner image from the photosensitive drum onto the sheet supplied along the sheet-transport pathway, the transferring unit being disposed in confrontation with the photosensitive drum and opposite the photosensitive drum with respect to the sheet-transport pathway.

7. An image forming device as claimed in claim 6, further comprising an exposure unit disposed opposite the transferring unit with respect to the photosensitive drum.

8. An image forming device as claimed in claim 1, further comprising an exposure unit disposed opposite the sheet-transport pathway with respect to the photosensitive drum.

9. An image forming device comprising:

a feeder unit including a sheet-supply roller for supplying sheets on which are to be formed images;

a photosensitive drum having a surface on which can be formed latent static electric images;

an exposure unit for forming a latent static electric image on the surface of the photosensitive drum;

a developing unit including a developing roller in confrontation with the photosensitive drum and for developing the latent static electric image on the surface of the photosensitive drum into a toner image;

a transferring unit for transferring the toner image from the photosensitive drum onto a sheet supplied by the feeder unit;

a fixing unit for thermally fixing the toner image onto the sheet;

a first drive mechanism for driving the photosensitive drum to rotate in a predetermined rotational direction at a predetermined peripheral speed in synchronization with supply of sheets; and a second drive mechanism for driving the developing roller of the developing unit to rotate in the predetermined rotational direction at at most two times the predetermined peripheral speed of the photosensitive drum.

10. An image forming device as claimed in claim 9, wherein the first and second drive mechanism are driven independently by different drive sources.

11. An image forming device as claimed in claim 10, wherein the sheet-supply roller, the transferring unit, and the fixing unit are disposed along a substantially linear transport pathway along which sheets are transported.

12. An image forming device as claimed in claim 11, wherein the photosensitive drum is disposed on one side of the transport pathway and the transferring unit is disposed on an opposite side of the transport pathway.

13. An image forming device as claimed in claim 12, wherein the exposure unit is disposed opposite the sheet-transport pathway with respect to the photosensitive drum.

14. An image forming device as claimed in claim 9, wherein the sheet-supply roller, the transferring unit, and the fixing unit are disposed along a substantially linear transport pathway along which sheets are transported.

* * * * *